US010221802B2

(12) United States Patent
Toda et al.

(10) Patent No.: US 10,221,802 B2
(45) Date of Patent: Mar. 5, 2019

(54) ENGINE CONTROLLING APPARATUS

(71) Applicant: MITSUBISHI JIDOSHA KOGYO KABUSHIKI KAISHA, Tokyo (JP)

(72) Inventors: Hitoshi Toda, Tokyo (JP); Toshiyuki Miyata, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 340 days.

(21) Appl. No.: 14/629,845

(22) Filed: Feb. 24, 2015

(65) Prior Publication Data

US 2015/0240740 A1 Aug. 27, 2015

(30) Foreign Application Priority Data

Feb. 25, 2014 (JP) ..... 2014-033890

(51) Int. Cl.
*F02D 41/30* (2006.01)
*F02D 41/04* (2006.01)
(Continued)

(52) U.S. Cl.
CPC ..... *F02D 41/3094* (2013.01); *F02D 41/047* (2013.01); *F02D 35/025* (2013.01);
(Continued)

(58) Field of Classification Search
CPC ..... F02D 41/047; F02D 41/3094; F02D 2200/021; F02D 2200/0402;
(Continued)

(56) References Cited

U.S. PATENT DOCUMENTS 7,114,488 B2 10/2006 Kinose
2005/0051147 A1* 3/2005 Nagaishi ..... F02D 41/047 123/676

(Continued)

FOREIGN PATENT DOCUMENTS

EP 1 985 833 A2 10/2008
JP 2005-325717 A 11/2005

(Continued)

OTHER PUBLICATIONS

Extended European Search Report dated Aug. 24, 2015 corresponding to European Patent Application No. 15155245.2.

*Primary Examiner* — John Zaleskas
(74) *Attorney, Agent, or Firm* — Birch, Stewart, Kolasch & Birch, LLP

(57) ABSTRACT

An engine controlling apparatus controls a cylinder injected volume of fuel injected from a cylinder injection valve of an engine into a cylinder, and a port injected volume of fuel injected from a port injection valve into an intake port. The engine controlling apparatus includes an adhesion volume calculator to calculate a cylinder adhesion volume of fuel adhering to the cylinder, the fuel being injected from the cylinder injection valve, and a port adhesion volume of fuel adhering to the intake port, the fuel being injected from the port injection valve. The engine controlling apparatus further includes a controller to control the cylinder injected volume and the port injected volume based on both the cylinder adhesion volume and the port adhesion volume.

13 Claims, 7 Drawing Sheets

(51) Int. Cl.
*F02D 41/18* (2006.01)
*F02D 35/02* (2006.01)

(52) U.S. Cl.
CPC ..... *F02D 41/182* (2013.01); *F02D 2200/021* (2013.01); *F02D 2200/0402* (2013.01); *F02D 2200/0406* (2013.01); *F02D 2200/0414* (2013.01); *F02D 2200/101* (2013.01); *F02D 2200/703* (2013.01)

(58) Field of Classification Search
CPC ..... F02D 2200/0406; F02D 2200/0414; F02D 2200/703; F02M 69/046
USPC ..... 123/299, 431, 445, 478, 480, 491; 701/102–104
See application file for complete search history.

(56) References Cited

U.S. PATENT DOCUMENTS

2005/0178360 A1* 8/2005 Satou ..... F02B 23/104 123/431
2005/0274353 A1* 12/2005 Okubo ..... F02D 41/0042 123/299
2006/0016429 A1* 1/2006 Mashiki ..... F02D 41/047 123/431
2006/0096576 A1 5/2006 Kinose
2006/0107650 A1* 5/2006 Tokuda ..... F02D 41/3029 60/284
2006/0207241 A1* 9/2006 Araki ..... F02D 41/0255 60/284
2006/0207560 A1* 9/2006 Kobayashi ..... F02D 41/047 123/431
2006/0225703 A1* 10/2006 Saito ..... F02D 41/047 123/431
2008/0162015 A1 7/2008 Shinohara et al.

FOREIGN PATENT DOCUMENTS

JP 2005-330833 A 12/2005
JP 2006037744 A * 2/2006 ..... F02D 41/047
JP 2006063947 A * 3/2006 ..... F02D 41/047
JP 2006144655 A * 6/2006 ..... F02D 41/047
JP 2006161766 A * 6/2006 ..... F02D 41/047
JP 2006-322404 A 11/2006
JP 2007032343 A * 2/2007 ..... F02D 41/047
JP 2007040212 A * 2/2007 ..... F02D 41/047
JP 2007064131 A * 3/2007 ..... F02D 41/047
JP 2007192088 A * 8/2007 ..... F02D 41/047
JP 2007-247454 A 9/2007
JP 2009-216037 A 9/2009
JP 4449706 B2 4/2010
JP 2010242647 A * 10/2010 ..... F02D 41/047
JP 2013213509 A * 10/2013 ..... F02D 41/3094

* cited by examiner

ENGINE CONTROLLING APPARATUS

CROSS-REFERENCE TO THE RELATED APPLICATION

This application incorporates by references the subject matter of Application No. 2014-033890 filed in Japan on Feb. 25, 2014 on which a priority claim is based under 35 U.S.C. § 119(a).

FIELD

The present invention relates to an engine controlling apparatus for controlling the volume of fuel injected from a cylinder injection valve into a cylinder and the volume of fuel injected from a port injection valve into an intake port in an engine.

BACKGROUND

Some traditional internal combustion engines have two parallel fuel injection modes, i.e., a cylinder injection mode, also called "direct injection mode", and a port injection mode. In other words, the engines use either one or both of cylinder injection valves for injecting fuel into cylinders and port injection valves for injecting fuel into intake ports of the cylinders depending on the operational states of the engines. Various techniques have been suggested for such engines to select a fuel injection mode depending on the loads on the engines and control the timings of injection of fuel.

The fuel injected from the port injection valves partially adheres to the surfaces of intake valves and the walls of the intake ports in the form of liquid layers. The liquidly-layered fuel gradually evaporates depending on the temperatures and pressures of the intake ports and slowly enters the cylinders. Unfortunately, the vaporization of the adhering fuel may take a long time at low temperatures of the intake ports, for example, as in the cold start of the engines. This phenomenon reduces the volumes of fuel introduced into the cylinders, resulting in leaner air-fuel ratios than intended.

A technique suggested to solve this problem is a combination of estimation of the volume of fuel adhering on the wall of an intake port and determination of the volume of fuel injection based on the estimated volume. For example, the technique involves the calculation of the volume of the fuel adhering on the intake-port wall on the basis of the load on the engine, and the correction of the volumes of port injection and cylinder injection on the basis of the calculated volume. An increase in the port injected volume on the basis of the volume of the fuel adhering on the wall leads to a proper ratio of the port injection to the cylinder injection and an optimum air-fuel ratio. If it is advisable to correct the volume of the fuel injected from a port injection valve to a value exceeding the maximum volume, the cylinder injected volume may also be increased to optimize the air-fuel ratio (e.g., refer to Japanese Patent No. 4449706).

In general, the cylinder injection receives fuel injected at a higher pressure than that in the port injection. The fuel is thus readily atomized in the cylinder and hardly adheres on the wall of the cylinder and the top surface of a piston. Unfortunately, the fuel injected from the cylinder injection valve may partially adhere on the inner surface of a combustion chamber in the cylinder in the form of a liquid layer. It is thus difficult to appropriately control the air-fuel ratio without consideration of the effects of fuel adhering on both the port and the cylinder.

In specific, a typical engine having two parallel fuel injection modes, i.e., cylinder injection and port injection modes, selects any one or a combination of these fuel injection modes depending on the operational state of the engine. Accordingly, in a transitional operational state occurring on the switching of fuel injection modes (e.g., immediately after the switching from the cylinder injection to the port injection), the required volume of cylinder injection may fall below the volume of fuel evaporated from the cylinder. In this case, the difference of the required volume of cylinder injection from the volume of fuel evaporated from the cylinder is subtracted from the port injected volume to prevent the state (rich state) of the cylinder containing excess fuel in the current operational state of the engine.

The cylinder injection is more responsive than the port injection and can lead to ready control of the air-fuel ratio. Unfortunately, the adhesion of fuel on the cylinder varies the fuel level in the cylinder and may cancel the advantage of the cylinder injection. For example, in the operational state of the engine that requires the precise control of the air-fuel ratio, the fuel adhering on the cylinder may impair the proper response of the air-fuel ratio. The air-fuel ratio is thus controlled in view of the effects of the fuel adhering on the cylinder to improve the response and the control of the air-fuel ratio.

SUMMARY

Technical Problems

An object of the invention, which has been accomplished to solve the above problems, is to provide an engine controlling apparatus with ready control of the air-fuel ratio in an engine running in both cylinder injection and port injection modes. Another object of the invention is to provide advantageous effects that are derived from the individual features described in the Description of Embodiment below but not from conventional techniques.

Solution to Problems (1) An engine controlling apparatus disclosed herein includes an adhesion volume calculator to calculate a cylinder adhesion volume of fuel adhering to a cylinder, the fuel being injected from a cylinder injection valve of an engine, and a port adhesion volume of fuel adhering to an intake port of the cylinder, the fuel being injected from a port injection valve of the engine; and a controller to control a cylinder injected volume of the fuel injected from the cylinder injection valve into the cylinder and a port injected volume of the fuel injected from the port injection valve into the intake port, based on both the cylinder adhesion volume and the port adhesion volume.

For example, the cylinder injected volume is controlled in view of not only the cylinder adhesion volume but also the port adhesion volume. The port injected volume is also controlled in view of not only the port adhesion volume but also the cylinder adhesion volume.

(2) The engine controlling apparatus preferably further includes an evaporation volume calculator to calculate a cylinder evaporated volume of fuel evaporated from the fuel adhering on the cylinder and a port evaporated volume of fuel evaporated from the fuel adhering on the intake port. In this case, the controller preferably controls the cylinder injected volume and the port injected volume, based on both the cylinder evaporated volume and the port evaporated volume.

The cylinder evaporated volume is preferably calculated from the evaporation rate in the cylinder and the cylinder adhesion volume. The port evaporated volume is preferably calculated from the evaporation rate in the port and the port adhesion volume. The evaporation rates in the cylinder and the port can be determined based on, for example, the temperature of coolant for the engine, the temperatures of cylinders, and/or the ambient temperature. Alternatively, the evaporation rates in the cylinder and the port may be determined in view of the intake pressure, the atmospheric pressure, the number of revolutions of the engine, and/or the load on the engine.

(3) The engine controlling apparatus preferably further includes a required volume calculator to calculate a required port-injected volume of fuel required to be injected from the port injection valve and a required cylinder-injected volume of fuel required to be injected from the cylinder injection valve. In this case, the controller preferably controls the port injected volume based on the difference calculated through subtraction of the cylinder evaporated volume from the required port-injected volume. The required port-injected volume and the required cylinder-injected volume can be determined based on, for example, the number of revolutions of the engine and/or the load on the engine.

(4) Preferably, if the cylinder evaporated volume is equal to or larger than the required cylinder-injected volume, the controller adjusts the port injected volume to a volume calculated through subtraction of the port evaporated volume and the difference between the required cylinder-injected volume and the cylinder evaporated volume from the required port-injected volume and adjust the cylinder injected volume to zero.

(5) Preferably, if the cylinder evaporated volume is smaller than the required cylinder-injected volume, the controller adjusts the port injected volume to the difference calculated through subtraction of the port evaporated volume from the required port-injected volume and adjust the cylinder injected volume to the difference calculated through subtraction of the cylinder evaporated volume from the required cylinder-injected volume.

(6) The controller preferably controls the cylinder injected volume based on the difference calculated through subtraction of the port evaporated volume from the required cylinder-injected volume.

(7) Preferably, if the port evaporated volume is equal to or larger than the required port-injected volume, the controller adjusts the cylinder injected volume to a volume calculated through subtraction of the cylinder evaporated volume and the difference between the required port-injected volume and the port evaporated volume from the required cylinder-injected volume and adjust the port injected volume to zero.

(8) Preferably, if the port evaporated volume is smaller than the required port-injected volume, the controller adjusts the cylinder injected volume to the difference calculated through subtraction of the cylinder evaporated volume from the required cylinder-injected volume and adjust the port injected volume to the difference calculated through subtraction of the port evaporated volume from the required port-injected volume.

(9) The engine controlling apparatus preferably further includes an injection ratio determiner to determine the injection ratio between the cylinder injection and the port injection. In this case, the cylinder injected volume and the port injected volume is preferably determined based on the injection ratio.

Advantageous Effects

The engine controlling apparatus calculates the cylinder adhesion volumes and the port adhesion volumes, and controls the volumes of fuel injected from the cylinder injection valve and the port injection valve based on the calculated volumes. The engine controlling apparatus thus can optimize the volume of fuel to be combusted in the cylinder under precise control of the air-fuel ratio.

BRIEF DESCRIPTION OF DRAWINGS

The nature of this invention, as well as other objects and advantages thereof, will be explained in the following with reference to the accompanying drawings, in which like reference characters designate the same or similar parts throughout the figures and wherein.

DESCRIPTION OF EMBODIMENTS

Figure 1:
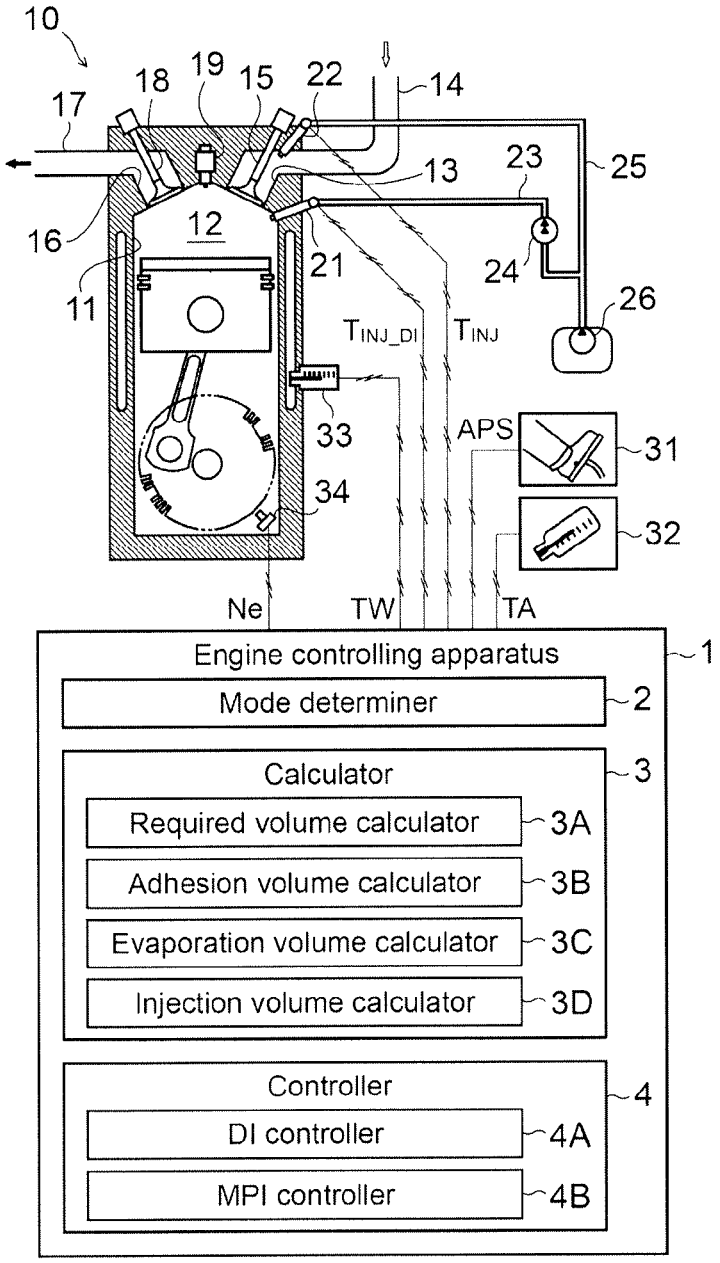
FIG. 1 is a schematic diagram illustrating the configuration of an engine controlled by an engine controlling apparatus according to an embodiment.

An engine controlling apparatus according to embodiments will now be described with reference to the accompanying drawings. The embodiments are mere illustrative examples and do not intend to exclude application of various modifications or techniques that are not described in the embodiments. The individual features of the embodiments may be modified in various manners without departing from the gist and/or selectively employed as necessary or properly combined with one another.

[1. Configuration of Apparatus]

An engine controlling apparatus according to the present embodiment is applied to an on-board gasoline engine 10 (hereinafter referred to simply as "engine 10") illustrated in FIG. 1. Cylinders 11 each include an intake port 13 and an exhaust port 16 at the top surface. The intake port 13 and the exhaust port 16 are respectively provided with an intake valve and an exhaust valve 18 at the openings. The engine 10 includes cylinder injection valves 21 and port injection valves 22 that are injectors for supplying fuel to the respective cylinders 11.

The cylinder injection valve 21 directly injects the fuel into a combustion chamber 12, whereas the port injection valve 22 injects the fuel into an intake port 13. The other cylinders (not shown) in the engine 10 each also provided with these two injectors. The volumes and timings of the fuel injection from the injection valves 21 and 22 are controlled by an engine controlling apparatus 1. For example, the engine controlling apparatus 1 transmits control pulse signals to the injection valve 21 or 22, and the injection valve 21 or 22 is opened for a period corresponding to the width of the signals. The fuel injected volume thus reflects the width of control pulse signals (driving pulse width) and the injection timing reflects the transmission time of control pulse signals.

The cylinder injection valve 21 is connected to a high-pressure pump 24 through a high-pressure fuel path 23, such as a common rail or a delivery pipe. The high-pressure fuel path 23 stores fuel pressurized in the high-pressure pump 24. The cylinder injection valve 21 is thus supplied with fuel at a higher pressure than that in the port injection valve 22. The cylinder injection valves 21 of the respective cylinders 11 receive fuel at substantially the same high pressure from the high-pressure fuel path 23. An increase in the pressure of fuel injected from the cylinder injection valve 21 causes a reduction in the diameter of the valve exit. This control can enhance the dispersion of fuel and promote atomization of fuel.

The port injection valve 22 is connected to a low-pressure pump 26 through a low-pressure fuel path 25. FIG. 1 illustrates an example configuration of the low-pressure pump 26 that can supply fuel to the port injection valve 22 and the high-pressure pump 24.

The high-pressure pump 24 and the low-pressure pump 26 both are mechanical or electrical pumps with variable flow rates for pumping fuel. The pumps 24 and 26 are driven by the engine 10 or a motor to pump the fuel from a fuel tank to the fuel paths 23 and 25, respectively. The volumes and pressures of the fuel from the pumps 24 and 26 are controlled by the engine controlling apparatus 1.

The vehicle includes an accelerator position sensor 31 for detecting the position of a pressed accelerator pedal (accelerator position AP [%]), and an ambient temperature sensor 32 for detecting the ambient temperature TA, at any position in the vehicle. The accelerator position AP corresponds to a driver request for acceleration or start, i.e., is correlated with the load P on the engine 10 (required output for the engine 10).

The engine 10 is provided with a water jacket or a circulation path for engine coolant, which includes a coolant temperature sensor 33 to detect the temperature of the engine coolant (coolant temperature TW) at an appropriate position. The coolant temperature TW reflects the temperature of the engine 10. In specific, a low temperature of the engine 10 indicates a low coolant temperature TW, whereas a high temperature of the engine 10 indicates a high coolant temperature TW. The coolant temperature TW and the ambient temperature TA are parameters that affect the evaporation rates of the fuel in the intake port 13 and the cylinder 11.

The engine 10 further includes an engine revolution sensor 34 for detecting a parameter corresponding to the number Ne of engine revolutions (hereinafter also referred to as "the number Ne of revolutions") in the vicinity of a crankshaft. According to the embodiment, the fuel injection mode is determined with reference to the accelerator position AP and the number Ne of revolutions of the engine 10. The information detected by the sensors 31 to 34 is transmitted to the engine controlling apparatus 1.

The engine 10 may further include a sensor for detecting the flow rate Q of intake air passing through a throttle valve and/or a sensor for detecting the intake pressure PIM (e.g., intake manifold pressure), which are not shown in FIG. 1, in an intake path 14 of the engine 10. The engine 10 may also include a sensor for detecting the air-fuel ratio A/F and/or a sensor for detecting the temperature TE of exhaust gas, in an exhaust path 17 of the engine 10. The information detected by these sensors is also transmitted to the engine controlling apparatus 1.

The engine controlling apparatus (engine electronic control unit) 1 is provided to a vehicle including the engine 10. The engine controlling apparatus 1 is composed of, for example, an electronic device composed of a microprocessor, such as a central processing unit (CPU) or a micro processing unit (MPU), a read only memory (ROM), and a random access memory (RAM) that are integrated. The engine controlling apparatus 1 is connected to a communication line of a network provided in the vehicle. The in-vehicle network includes various known electronic controllers, such as a brake controller, a transmission controller, a vehicle stabilizer, an air conditioner, and an electrical device controller, which are connected for mutual communication.

Figure 2:
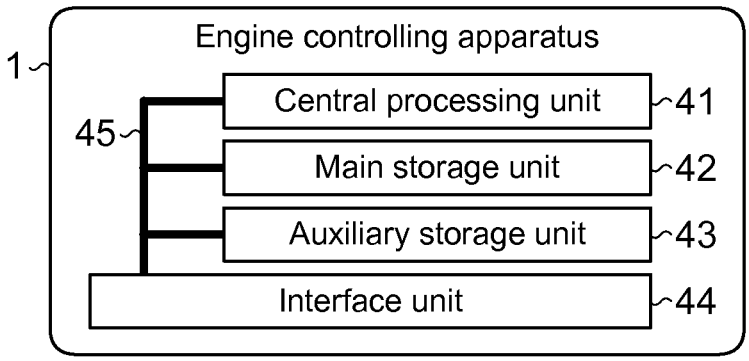
FIG. 2 illustrates the hardware configuration of the engine controlling apparatus illustrated in FIG. 1.

FIG. 2 illustrates the hardware configuration of the engine controlling apparatus 1. The engine controlling apparatus 1 includes a central processing unit 41, a main storage unit 42, an auxiliary storage unit 43, and an interface unit 44, which are connected for mutual communication through an internal bus 45. These units 41 to 44 are energized by a power source (not shown), such as an in-vehicle battery or a button battery.

The central processing unit 41 is a processor including a control unit (control circuit), an arithmetic unit (arithmetic circuit), and a cache memory (register), and includes the CPU or MPU, for example. The main storage unit 42 stores programs and working data, and includes the RAM and ROM, for example. The auxiliary storage unit 43 stores programs and data to be stored for longer periods than those in the main storage unit 42, and includes the ROM in the microprocessor and memories, such as a flash memory, a hard disk drive (HDD), and a solid state drive (SSD), for example.

The interface unit 44 mediates the input and output (Input/Output; I/O) between the engine controlling apparatus 1 and its outside. For example, the engine controlling apparatus 1 is connected to the in-vehicle network via the interface unit 44, or directly connected to the sensors 31 to 34. The engine controlling apparatus 1 transmits and receives information to and from the sensors 31 to 34 in the vehicle and an external control system via the interface unit 44.

The engine controlling apparatus 1 comprehensively controls various systems, such as an ignition system, a fuel injection system, an intake and exhaust system, and a valve system, on the engine 10. The engine controlling apparatus 1 controls the volumes of air and fuel supplied to the respective cylinders 11 of the engine 10 and the timing of ignition in the cylinders 11. Specific targets to be controlled by the engine controlling apparatus 1 include the volumes and timings of fuel injection from the cylinder injection valve 21 and the port injection valve 22, the ignition timing of a spark plug 19, the valve lifts and valve timings of the intake valve 15 and the exhaust valve 18, and the opening of the throttle valve.

The following explanation of the embodiment focuses on an injection mode control for selecting a fuel injection mode, such as a cylinder injection or port injection mode, and an injected volume control for controlling the volumes of fuel injected from the cylinder injection valve 21 and the port injection valve 22. These controls are recorded in the auxiliary storage unit 43 or a removable medium, for example, in the form of application programs. The programs are loaded in a memory space of the main storage unit 42 and are executed by the central processing unit 41.

[2. Description of Control]

[2-1. Injected Volume and Injection Mode Control]

The injection mode control selects an appropriate fuel injection mode, such as a cylinder injection or port injection mode, depending on the operational state of the engine 10, the load P on the engine 10, and/or required output for the engine 10. The injection mode control selects either an "MPI mode" involving the port injection alone, a "DI mode" involving the cylinder injection alone, or a "DI+MPI mode" involving both the port injection and cylinder injection, based on, for example, the number Ne of revolutions of the engine 10, the load P on the engine 10, the air volume, the charging efficiency Ec (e.g., desirable charging efficiency or actual charging efficiency), the accelerator position AP, and/or the coolant temperature TW. These fuel injection modes are appropriately switched depending on the operational state of the engine 10 and the running state of the vehicle.

The injected volume control adjusts the volumes of fuel injected from the cylinder injection valve 21 and the port injection valve 22 in view of the volumes of the fuel adhering to both the intake port 13 and the combustion chamber 12 and the volumes of evaporation from the adhering fuel. The control determines the states of adhesion and evaporation of the fuel injected from the cylinder injection valve 21 and the states of adhesion and evaporation of the fuel injected from the port injection valve 22.

The volume of the fuel adhering to the intake port 13 is hereinafter referred to as "port adhesion volume." The port adhesion volume indicates the total volume of the fuel spattered on the inner wall of the intake port 13 (wall portion) and on the surface of the intake valve 15 adjacent to the intake port 13 (valve portion). The volume of evaporation from the fuel adhering on the intake port 13 is referred to as "port evaporated volume." The port evaporated volume indicates the total volume of the fuel evaporated from the inner wall of the intake port 13 and from the intake valve 15. In the same manner, the volume of the fuel adhering to the combustion chamber 12 is referred to as "cylinder adhesion volume," and the volume of evaporation from the fuel adhered to the combustion chamber 12 is referred to as "cylinder evaporated volume."

The port adhesion volume and the port evaporated volume are referenced in not only the control on the volume of the fuel injected from the port injection valve 22 but also the control on the volume of the fuel injected from the cylinder injection valve 21. This configuration can control the volume of fuel based on the port evaporated volume without the effects of the evaporation of fuel occurring after the stop of the port injection. In the same manner, the cylinder adhesion volume and the cylinder evaporated volume are also referenced in the control on the volume of the fuel injected from the port injection valve 22. This configuration can control the volume of the fuel based on the cylinder evaporated volume during the standby mode of the cylinder injection.

[2-2. MPI Injection Model]

Figure 3A:
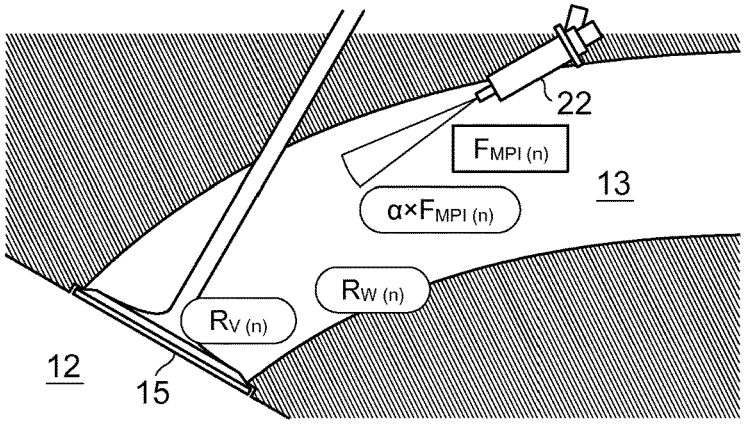
FIGS. 3A to 3C are schematic illustration of calculation of the volume of port injection.
Figure 3B:
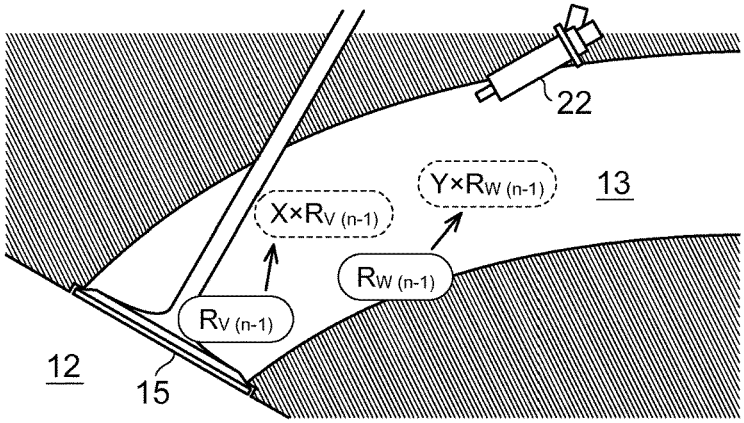
Figure 3C:
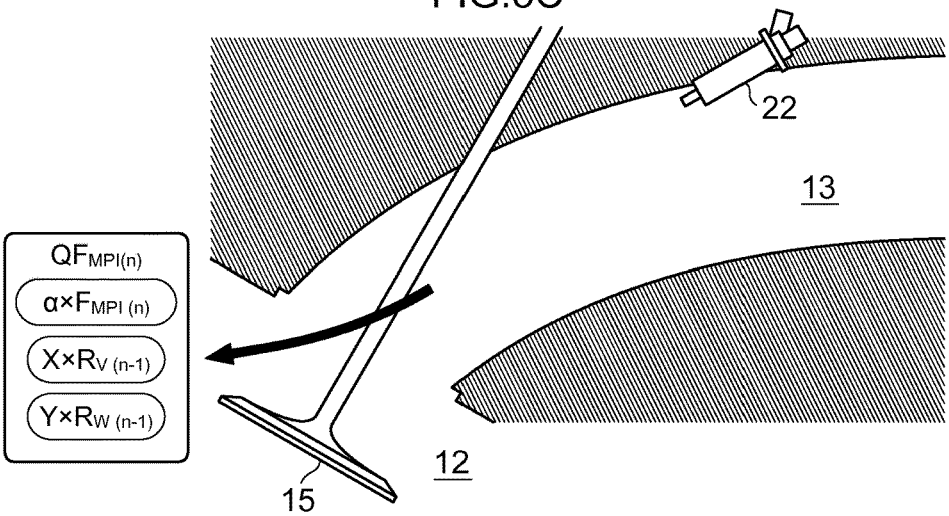
Figure 4A:
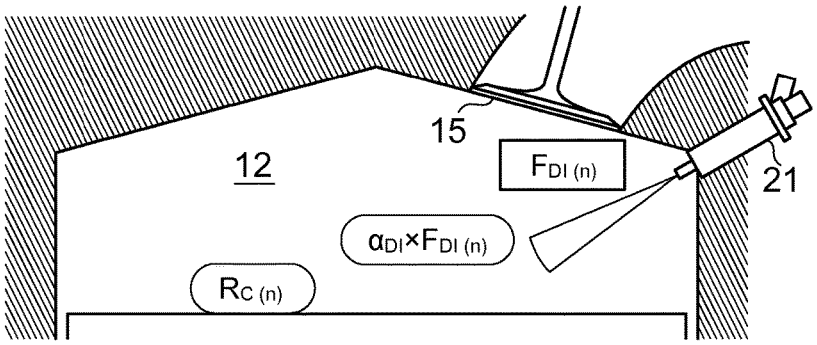
FIGS. 4A to 4C are schematic illustration of calculation of the volume of cylinder injection.
Figure 4B:
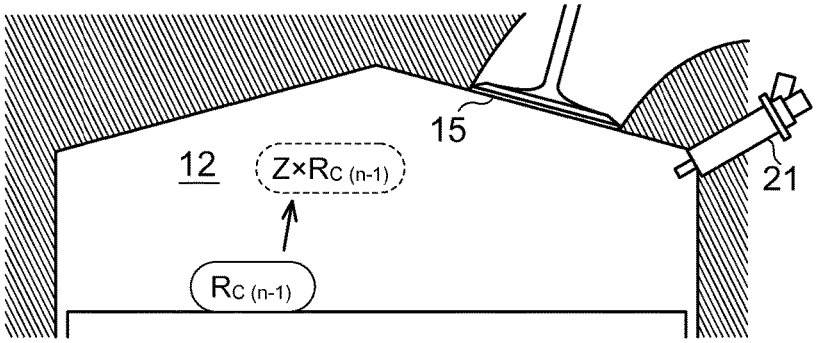
Figure 4C:
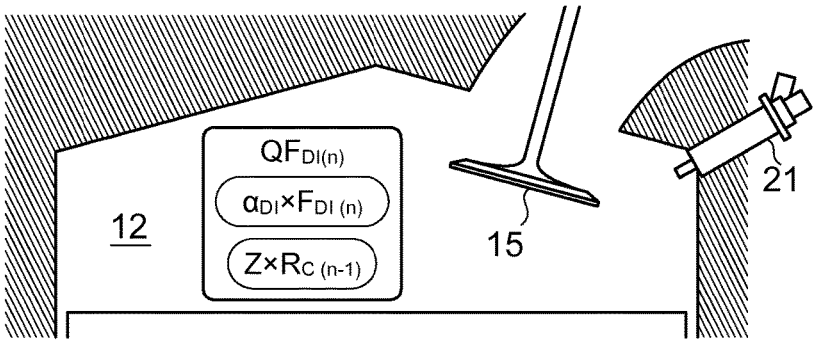

FIGS. 3A to 3C illustrate a state model of fuel injected into the intake port 13, whereas FIGS. 4A to 4C illustrate a state model of fuel injected into the combustion chamber 12. The sign n in these figures represents the ordinal number of fuel injections. For example, a value with a sign (n−1) represents a value in the combustion cycle, one cycle before that of a value with a sign n.

With reference to FIG. 3A, the volume of fuel to be directly introduced into the cylinder 11 without adhering on the inner wall or the intake valve 15 in the intake port 13 is expressed in $\alpha \times F_{MPI(n)}$, where $F_{MPI(n)}$ represents the volume (port injected volume) of the fuel injected from the port injection valve 22, and $\alpha$ represents the factor of direct introduction of the fuel.

The fuel injected from the port injection valve 22 is partially adhering on the inner wall of the intake port 13 and the surface of the intake valve 15. The port adhesion volume is expressed in $(R_{V(n)}+R_{W(n)})$, where $R_{W(n)}$ represents the volume of the fuel adhering on the inner wall of the intake port 13 and $R_{V(n)}$ represents the volume of the fuel adhering on the intake valve 15. The port injected volume $F_{MPI(n)}$ from the port injection valve 22 is equal to the sum of $\alpha \times F_{MPI(n)}$, $R_{V(n)}$, and $R_{W(n)}$.

The evaporation rate of the fuel adhering on the inner wall of the intake port 13 during a single cycle until the subsequent fuel injection is referred to as "wall evaporation rate Y." The evaporation rate of the fuel adhering on the intake valve 15 during a single cycle until the subsequent fuel injection is referred to as "valve evaporation rate X." With reference to FIG. 3B, the volume of the fuel adhering on and then evaporated from the inner wall of the intake port 13 in the volume $F_{MPI(n-1)}$ of the preceding injection from the port injection valve 22 is expressed in $Y \times R_{W(n-1)}$. The volume of the fuel adhering on and then evaporated from the intake valve 15 in the volume $F_{MPI(n-1)}$ of the preceding injection from the port injection valve 22 is expressed in $X \times R_{V(n-1)}$. The port evaporated volume is equal to the sum of $X \times R_{V(n-1)}$ and $Y \times R_{W(n-1)}$.

With reference to FIG. 3C, a part $\alpha \times F_{MPI(n)}$ of the volume $F_{MPI(n)}$ of the current injection from the port injection valve 22, and a part $(X \times R_{V(n-1)}+Y \times R_{W(n-1)}$ of the volume $F_{MPI(n-1)}$ of the preceding injection are introduced into the combustion chamber 12, after the opening of the intake valve 15 during an intake stroke of the engine 10. The port injected volume $F_{MPI(n)}$ from the port injection valve 22 would thus be controlled such that the volume (required port-injected volume $QF_{MPI}$) required by the engine 10 equals the total volume of the introduced fuel.

[2-3. DI Injection Model]

With reference to FIG. 4A, the volume of fuel to be combusted without adhering on the inner wall of the cylinder 11 or the top surface of a piston in the combustion chamber 12 or the ceiling of the combustion chamber 12 is expressed in $\alpha_{DI} \times F_{DI(n)}$, where $F_{DI(n)}$ represents the volume (cylinder injected volume) of the fuel injected from the cylinder injection valve 21, and $\alpha_{DI}$ represents the rate of contribution of the fuel to the combustion.

The fuel injected from the cylinder injection valve 21 is partially adhering on the cylinder. The volume $F_{DI(n)}$ of the fuel injected from the cylinder injection valve 21 is equal to the sum of $\alpha_{DI} \times F_{DI(n)}$ and $R_{C(n)}$, where $R_{C(n)}$ represents the volume (cylinder adhesion volume) of the fuel adhering on the cylinder.

The evaporation rate of the fuel adhering on the cylinder during a single cycle until the subsequent fuel injection is referred to as "cylinder evaporation rate Z." With reference to FIG. 4B, the volume (cylinder evaporated volume) of the fuel adhering on and then evaporated from the cylinder in the volume $F_{DI(n-1)}$ of the preceding injection from the cylinder injection valve 21 is expressed in $Z \times R_{C(n-1)}$. In other words, the volume of the fuel injected from the cylinder injection valve 21 for combustion is equal to the sum of a part $\alpha_{DI} \times F_{DI(n)}$ of the volume $F_{DI(n)}$ of the current injection and a part $Z \times R_{C(n-1)}$ of the volume $F_{DI(n-1)}$ of the preceding injection. The cylinder injected volume $F_{DI(n)}$ from the cylinder injection valve 21 would thus be controlled such that the volume (required cylinder-injected volume $QF_{DI}$) required by the engine 10 equals the total volume of the combusted fuel, as illustrated in FIG. 4C.

[3. Configuration of Control]

With reference to FIG. 1, the engine controlling apparatus 1 includes a mode determiner 2, a calculator 3, and a controller 4 for executing the above-explained controls. The mode determiner 2 executes the injection mode control to select a fuel injection mode. The calculator 3 and the controller 4 execute the injected volume control. The calculator 3 calculates the adhesion volumes, the evaporated volumes, and the injected volumes. The controller 4 controls the cylinder injection valve 21 and the port injection valve 22 to actually inject the fuel injected volumes calculated by the calculator 3. These elements in the engine controlling apparatus 1 may be electronic circuits (hardware), or may be incorporated into a program (software). Alternatively, some of the functions of the elements may be provided in the form of hardware while the other may be provided in the form of software.

[3-1. Mode Determiner]

The mode determiner (injection ratio determiner) 2 calculates the load P on the engine 10, and selects a fuel injection mode based on the load P and the number Ne of revolutions of the engine 10. The load P can be calculated based on, for example, the flow rate Q of intake air and/or the flow rate of exhaust air. Alternatively, the load P may be calculated based on the accelerator position AP. The load P may also be calculated based on any other information, such as the intake pressure PIM, the exhaust pressure, the vehicle speed, the charging efficiency Ec, the volumetric efficiency Ev, the operational states of various load devices provided in the vehicle, and/or the environment around the vehicle.

In the DI+MPI mode, the mode determiner 2 calculates the ratio (injection ratio) $R_{DI}$ of the cylinder injection to the entire fuel injection during a single combustion cycle. The ratio $R_{DI}$ may be replaced with the ratio $R_{DI}/R_{MPI}$ of the cylinder injection to the port injection. Because the sum of the ratio $R_{DI}$ of the cylinder injection and the ratio $R_{MPI}$ of the port injection is 1 ($R_{DI}+R_{MPI}=1$) in the DI+MPI mode, the ratio $R_{DI}/R_{MPI}$ of the cylinder injection to the port injection is also expressed in $R_{DI}/(1-R_{DI})$.

The ratio $R_{DI}$ is determined depending on the load P on the engine 10. For example, a deeper accelerator position AP leads to a lower ratio $R_{DI}$. In other words, a driver request for rapid acceleration or sudden start causes an increase in the ratio of the port injection. The selected fuel injection mode and the calculated injection ratio are transmitted to the calculator 3 and the controller 4.

[3-2. Calculator]

The calculator 3 includes a required volume calculator 3A, an adhesion volume calculator 3B, an evaporation volume calculator 3C, and an injection volume calculator 3D.

The required volume calculator 3A calculates a required fuel volume QF representing the total volume of fuel injection during a single combustion cycle, and distributes the required fuel volume QF to the port injection and the cylinder injection based on the ratio $R_{DI}$ of the cylinder injection calculated by the mode determiner 2.

The required fuel volume QF is calculated based on, for example, the required load P on the engine 10, the accelerator position AP, the number Ne of revolutions of the engine 10, and/or the air-fuel ratio A/F. The required cylinder-injected volume $QF_{DI}$ is calculated through multiplication of the required fuel volume QF by the ratio $R_{DI}$. The required port-injected volume $QF_{DI}$ is calculated through subtraction of the required cylinder-injected volume $QF_{DI}$ from the required fuel volume QF. The calculated required cylinder-injected volume $QF_{DI}$ and required port-injected volume $QF_{MPI}$ are transmitted to the injection volume calculator 3D.

The adhesion volume calculator 3B calculates the cylinder adhesion volume $R_C$ and the port adhesion volume ($R_V+R_W$) from the volumes $F_{DI}$ and $F_{MPI}$ of the fuel actually injected from the cylinder injection valve 21 and the port injection valve 22, respectively, during the preceding combustion cycle. The cylinder adhesion volume $R_C$ is calculated from an expression or map containing at least the preceding cylinder injected volume $F_{DI(n-1)}$. In the same manner, each portion $R_V$ or $R_W$ of the port adhesion volume ($R_V+R_W$) is calculated from an expression or map containing at least the preceding port injected volume $F_{MPI(n-1)}$.

The adhesion volumes $R_C$, $R_V$, and $R_W$ is preferably calculated in view of the volume of the fuel remaining unevaporated during the preceding combustion cycle in addition to the preceding injected volumes $F_{DI(n-1)}$ and $F_{MPI(n-1)}$. Alternatively, the cylinder adhesion volume $R_C$ and the port adhesion volume ($R_V+R_W$) may be calculated in view of the pressure (intake pressure PIM) in the intake port 13, the flow rate Q of intake air, the flow velocity, the ambient temperature TA, and/or the coolant temperature TW. The calculated cylinder adhesion volume $R_C$ and port adhesion volume ($R_V+R_W$) are transmitted to the evaporation volume calculator 3C.

The evaporation volume calculator 3C calculates the cylinder evaporated volume and the port evaporated volume respectively representing the volumes of evaporation from the fuel adhering on the combustion chamber 12 and the intake port 13 during the preceding combustion cycle. The cylinder evaporated volume is the product of the cylinder adhesion volume $R_C$ and the cylinder evaporation rate Z, as described above.

The port evaporated volume consists of the volume of evaporation from the wall portion of the intake port 13 and the volume of evaporation from the valve portion. In specific, the volume of evaporation from the valve portion is the product of the adhesion volume $R_V$ on the valve portion and the valve evaporation rate X, whereas the volume of evaporation from the wall portion is the product of the adhesion volume $R_W$ on the wall portion and the wall evaporation rate Y. The sum of the evaporated volumes is equal to the port evaporated volume. The evaporation rates X, Y, and Z are calculated based on the temperatures of portions to which the fuel is adhering, the flow velocity of air passing through the intake port 13, the ambient temperature TA, the pressure (intake pressure PIM) in the intake port 13, and/or the coolant temperature TW. Alternatively, the evaporation rates X, Y, and Z may be calculated in view of the atmospheric pressure, the number Ne of engine revolutions, and/or the load P. The calculated cylinder evaporated volume $Z\times R_C$ and port evaporated volume ($X\times R_V+Y\times R_W$) are transmitted to the injection volume calculator 3D.

The injection volume calculator 3D calculates the cylinder injected volume Fox representing the volume of fuel injected from the cylinder injection valve 21 and the port injected volume $F_{MPI}$ representing the volume of fuel injected from the port injection valve 22. The volumes $F_{DI}$ and $F_{MPI}$ are calculated from both the cylinder adhesion volume $R_C$ and the port adhesion volume ($R_V+R_W$). In other words, the port injected volume $F_{MPI}$ is calculated in view of the effects of the cylinder adhesion volume $R_C$ (cylinder evaporated volume $Z\times R_C$) even in the operational state involving no cylinder injection. The cylinder injected volume $F_{DI}$ is also calculated in view of the effects of the port adhesion volume ($R_V$+$R_W$) (port evaporated volume ($X \times R_V + Y \times R_W$)) even in the operational state involving no port injection.

The port injected volume $F_{MPI}$ is the quotient of a value by the factor α of direct introduction of the fuel, the value being calculated through subtraction of the port evaporated volume ($X \times R_V + Y \times R_W$) and the difference $TR_{C(n)}$ between the cylinder evaporated volume $Z \times R_C$ and the required cylinder-injected volume $QF_{DI}$ from the required port-injected volume $QF_{MPI(n)}$. The difference $TR_{C(n)}$ is subtracted from the port injection to compensate for the effects of the cylinder evaporated volume $Z \times R_C$. It is noted that the difference $TR_{C(n)}$ is limited to 0 or larger. Accordingly, the effects of the cylinder evaporated volume $Z \times R_C$ are taken into consideration only if the cylinder evaporated volume $Z \times R_C$ is equal to or larger than the required cylinder-injected volume $QF_{DI}$. The injection volume calculator 3D stores port injected volumes $F_{MPI}$ thus calculated in order of the combustion cycles, where the port injected volumes $F_{MPI}$ of several cycles are stored, for example.

The injection volume calculator 3D calculates the operating time $T_{INJ}$ of the port injection valve 22 through multiplication of the port injected volume $F_{MPI}$ by a predetermined conversion factor $X_{INJ}$. The conversion factor $X_{INJ}$ may be a predetermined constant, for example, or may be calculated based on the pressure and/or viscosity of fuel supplied to the port injection valve 22 and/or the coolant temperature TW. The calculated operating time $T_{INJ}$ is transmitted to the controller 4.

The cylinder injected volume $F_{DI}$ is the quotient of a value by the rate $\alpha_{DI}$ of contribution of the fuel to the combustion, the value being calculated through subtraction of the cylinder evaporated volume $Z \times R_C$ and the difference $TR_{VW(n)}$ between the port evaporated volume ($X \times R_V + Y \times R_W$) and the required port-injected volume $QF_{MPI}$ from the required cylinder-injected volume $QF_{DI(n)}$. The difference $TR_{VW(n)}$ is subtracted from the cylinder injection to compensate for the effects of the port evaporated volume ($X \times R_V + Y \times R_W$). It is noted that the difference $TR_{VW(n)}$ is limited to or larger, like the difference $TR_{C(n)}$. Accordingly, the effects of the port evaporated volume ($X \times R_V + Y \times R_W$) are taken into consideration only if the port evaporated volume ($X \times R_V + Y \times R_W$) is equal to or larger than the required port-injected volume $QF_{MPI}$. The injection volume calculator 3D stores cylinder injected volumes $F_{DI}$ thus calculated in order of the combustion cycles, where the cylinder injected volumes $F_{DI}$ of several cycles are stored, for example.

The injection volume calculator 3D calculates the operating time $T_{INJ_DI}$ of the cylinder injection valve 21 through multiplication of the cylinder injected volume Fox by a predetermined conversion factor $X_{INJ_DI}$. The conversion factor $X_{INJ_DI}$ may be a predetermined constant, for example, or may be calculated based on the pressure and/or viscosity of fuel supplied to the cylinder injection valve 21 and/or the coolant temperature TW. The calculated operating time $T_{INJ_DI}$ is transmitted to the controller 4.

[3-3. Controller]

The controller 4 includes a DI controller 4A and an MPI controller 4B. The DI controller 4A outputs control pulse signals for driving the cylinder injection valve 21 based on the operating time $T_{INJ_DI}$ calculated by the calculator 3. The MPI controller 4B outputs control pulse signals for driving the port injection valve 22 based on the operating time $T_{INJ}$ calculated by the calculator 3.

Through this control, the volume of the fuel actually injected from the cylinder injection valve 21 equals the cylinder injected volume $F_{DI}$, and the volume of the fuel actually injected from the port injection valve 22 equals the port injected volume $F_{MPI}$. It is noted that the cylinder injection valve 21 actually injects fuel in the DI mode or the DI+MPI mode, whereas the port injection valve 22 actually injects fuel in the MPI mode or the DI+MPI mode.

[4. Flowchart]

Figure 5:
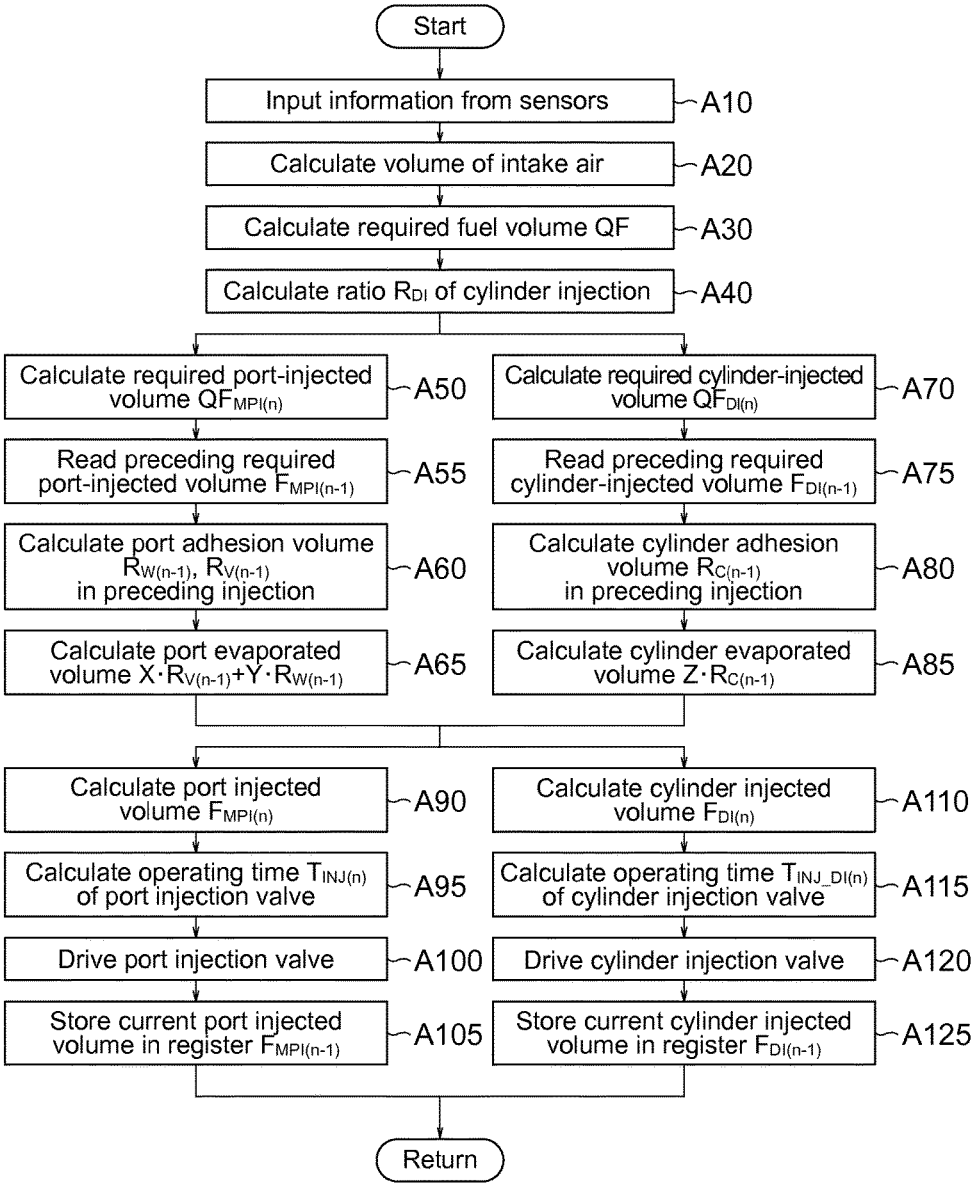
FIG. 5 is a flowchart illustrating the control process in the engine controlling apparatus illustrated in FIG. 1.

FIG. 5 is a flowchart illustrating the process of calculating and controlling the cylinder injected volume Fox and the port injected volume $F_{MPI}$ in a single combustion cycle. Steps A50 to A65 and Steps A70 to A85 in this process may be executed in parallel, or in sequence such that one group of steps precedes the other group. The same can also be applied to Steps A90 to A105 and Steps A110 to A125.

In Step A10, the information detected by the sensors 31 to 34 is input to the engine controlling apparatus 1. Examples of the input information include the accelerator position AP, the ambient temperature TA, the coolant temperature TW, and the number Ne of engine revolutions. In Step A20, the required volume calculator 3A calculates the volume of intake air to be introduced into the combustion chamber 12 based on the accelerator position AP and the number Ne of engine revolutions. In Step A30, the required volume calculator 3A calculates the required fuel volume QF in a single combustion cycle, based on the volume of intake air calculated in Step A20. The calculated required fuel volume QF includes the volume of fuel to be injected from the cylinder injection valve 21 and the volume of fuel to be injected from the port injection valve 22.

In Step A40, the mode determiner 2 selects a fuel injection mode based on the load P on the engine 10 and the number Ne of engine revolutions, and calculates the ratio $R_{DI}$ of the cylinder injection. For example, if the selected fuel injection mode is the DI mode, then the mode determiner 2 sets the ratio $R_{DI}$ to 1; if the selected fuel injection mode is the MPI mode, then the mode determiner 2 sets the ratio $R_{DI}$ to 0; or if the selected fuel injection mode is the DI+MPI mode, then the mode determiner 2 sets the ratio $R_{DI}$ to a value within the range of $0 \leq R_{DI} \leq 1$ depending on the accelerator position AP.

Steps A50 to A65 are the process for calculating the port evaporated volume. In Step A50, the required volume calculator 3A calculates the required port-injected volume $QF_{MPI(n)}$ in the current combustion cycle, based on the required fuel volume QF and the ratio $R_{DI}$. Because the ratio $R_{DI}$ indicates the ratio of the injection from the cylinder injection valve 21, the required port-injected volume $QF_{MPI(n)}$ is calculated through multiplication of the difference of the ratio $R_{DI}$ from 1 by the required fuel volume QF ($QF_{MPI(n)} = QF \times (1 - R_{DI})$).

In Step A55, the adhesion volume calculator 3B reads information on the port injected volume $F_{MPI(n-1)}$ calculated in the preceding combustion cycle from the injection volume calculator 3D. In Step A60, the adhesion volume calculator 3B calculates the each port adhesion volume ($R_{V(n-1)}$, $R_{W(n-1)}$) based on the preceding port injected volume $F_{MPI(n-1)}$. The each port adhesion volume ($R_{V(n-1)}$, $R_{W(n-1)}$) is preferably calculated in view of the volume of the fuel remaining unevaporated during the preceding combustion cycle (e.g., $(1-X) \times R_{V(n-2)}$, $(1-Y) \times R_{W(n-2)}$.

In Step A65, the evaporation volume calculator 3C calculates the port evaporated volume ($X \times R_{V(n-1)} + Y \times R_{W(n-1)}$, based on the each port adhesion volume ($R_{V(n-1)}$, $R_{W(n-1)}$) calculated in Step A60 and the each evaporation rates X and Y.

Steps A70 to A85 are the process for calculating the cylinder evaporated volume. In Step A70, the required volume calculator 3A calculates the required cylinder-injected volume $QF_{DI(n)}$ in the current combustion cycle, based on the required fuel volume QF and the ratio $R_{DI}$. The required cylinder-injected volume $QF_{DI(n)}$ is calculated through multiplication of the required fuel volume QF by the ratio $R_{DI}$ ($QF_{DI(n)}=QF\times R_{DI}$).

In Step A75, the adhesion volume calculator 3B reads information on the cylinder injected volume $F_{DI(n-1)}$ calculated in the preceding combustion cycle from the injection volume calculator 3D. In Step A80, the adhesion volume calculator 3B calculates the cylinder adhesion volume $R_{C(n-1)}$ based on the preceding cylinder injected volume $F_{DI(n-1)}$. The cylinder adhesion volume $R_{C(n-1)}$ is preferably calculated in view of the volume of the fuel remaining unevaporated during the preceding combustion cycle (e.g., $(1-Z)\times R_{C(n-2)}$).

In Step A85, the evaporation volume calculator 3C calculates the cylinder evaporated volume $Z\times R_{C(n-1)}$, based on the cylinder adhesion volume $R_{C(n-1)}$ calculated in Step A80 and the cylinder evaporation rate Z.

Steps A90 to A105 are the process for calculating the port injected volume $F_{MPI(n)}$ and controlling the port injection valve 22. In Step A90, the injection volume calculator 3D calculates the port injected volume $F_{MPI(n)}$. The port injected volume $F_{MPI(n)}$ is calculated in view of the effects of both the port evaporated volume ($X\times R_{V(n-1)}+Y\times R_{W(n-1)}$) and the cylinder evaporated volume $Z\times R_{C(n-1)}$.

It is noted that the effects of the cylinder evaporated volume $Z\times R_{C(n-1)}$, are taken into consideration only if the cylinder evaporated volume $Z\times R_{C(n-1)}$ is equal to or larger than the required cylinder-injected volume $QF_{DI(n)}$. For example, after the switching of fuel injection modes from the DI or DI+MPI mode to the MPI mode, the cylinder evaporated volume estimated from the adhering fuel that was injected from the cylinder injection valve 21 is subtracted from the port injected volume $F_{MPI(n)}$. The control involving this subtraction can avoid a high air-fuel ratio caused by the fuel remaining in the combustion chamber 12, and can improve the control and the response of the air-fuel ratio.

In Step A95, the injection volume calculator 3D calculates the operating time $T_{INJ(n)}$ of the port injection valve 22 through multiplication of the port injected volume $F_{MPI(n)}$ by the conversion factor $X_{INJ}$. In Step A100, the MPI controller 4B outputs control pulse signals having a pulse width corresponding to the operating time $T_{INJ(n)}$ to the port injection valve 22. The port injection valve 22 is thus controlled to inject an exact port injected volume $F_{MPI(n)}$.

In Step A105, the injection volume calculator 3D stores information on the port injected volume $F_{MPI(n)}$ in the current combustion cycle in a register $F_{MPI(n-1)}$. The information that has been stored in the register $F_{MPI(n-1)}$ is re-stored in a register $F_{MPI(n-2)}$ for information one more combustion cycle before. The information stored in the register $F_{MPI(n-1)}$ is referenced by the adhesion volume calculator 3B to calculate the port adhesion volume ($R_{V(n-1)}+R_{W(n-1)}$) in the subsequent combustion cycle.

Steps A110 to A125 are the process for calculating the cylinder injected volume $F_{DI(n)}$ and controlling the cylinder injection valve 21. In Step A110, the injection volume calculator 3D calculates the cylinder injected volume $F_{DI(n)}$. The cylinder injected volume $F_{DI(n)}$ is also calculated in view of the effects of both the cylinder evaporated volume $Z\times R_{C(n-1)}$ and the port evaporated volume ($X\times R_{V(n-1)}+Y\times R_{W(n-1)}$).

It is noted that the effects of the port evaporated volume ($X\times R_{V(n-1)}+Y\times R_{W(n-1)}$) are taken into consideration only if the port evaporated volume ($X\times R_{V(n-1)}+Y\times R_{W(n-1)}$) is equal to or larger than the required port-injected volume $QF_{MPI(n)}$. For example, after the switching of fuel injection modes from the MPI or DI+MPI mode to the DI mode, the port evaporated volume estimated from the adhering fuel that was injected from the port injection valve 22 is subtracted from the cylinder injected volume $F_{DI(n)}$. The control involving this subtraction can avoid a high air-fuel ratio caused by the fuel remaining in the intake port 13, and can improve the control and the response of the air-fuel ratio.

In Step A115, the injection volume calculator 3D calculates the operating time $T_{INJ_DI(n)}$ of the cylinder injection valve 21 through multiplication of the cylinder injected volume $F_{DI(n)}$ by the conversion factor $X_{INJ_DI}$. In Step A120, the DI controller 4A outputs control pulse signals having a width corresponding to the operating time $T_{INJ_DI(n)}$ to the cylinder injection valve 21. The cylinder injection valve 21 is thus controlled to inject an exact cylinder injected volume $F_{DI(n)}$.

In Step A125, the injection volume calculator 3D stores information on the cylinder injected volume $F_{DI(n)}$ in the current combustion cycle in a register $F_{DI(n-1)}$. The information that has been stored in the register $F_{DI(n-1)}$ is restored in a register $F_{DI(n-2)}$ for information one more combustion cycle before. The information stored in the register $F_{DI(n-1)}$ is referenced by the adhesion volume calculator 3B to calculate the cylinder adhesion volume $R_{C(n-1)}$ in the subsequent combustion cycle.

[5. Operations]

[5-1. Switching from DI Mode to MPI Mode]

A variation in the air-fuel ratio caused by the switching of fuel injection modes will now be explained.

Figure 6A:
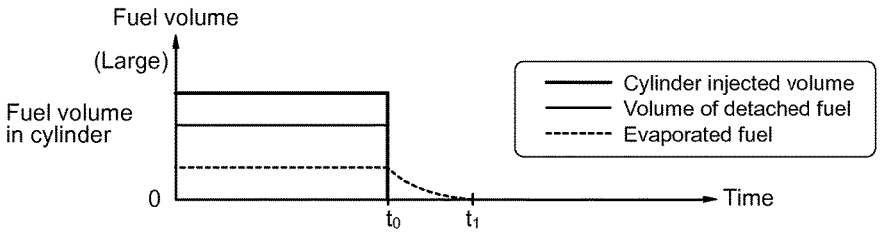
FIGS. 6A to 6D are graphs illustrating control operations in the switching from cylinder injection to port injection.

As illustrated with a thick solid line in FIG. 6A, the cylinder injected volume $F_{DI}$ is constant in the DI mode. The volume of the fuel not adhering on the combustion chamber 12 is calculated through subtraction of the cylinder adhesion volume $R_C$ from the cylinder injected volume $F_{DI}$, and is smaller than the cylinder injected volume $F_{DI}$, as illustrated with a thin solid line. The cylinder evaporated volume illustrated with a dashed line is equal to the product ($Z\times R_C$) of the cylinder adhesion volume $R_C$ and the cylinder evaporation rate Z. In the DI mode, the cylinder injected volume $F_{DI}$ is corrected so as to increase with the cylinder adhesion volume $R_C$ or to decrease with the cylinder evaporated volume $Z\times R_C$.

At a time to of the switching of fuel injection modes from the DI mode to the MPI mode, the cylinder injected volume $F_{DI}$ drops to 0. The volume of the fuel not adhering on the combustion chamber 12 (thin solid line) also drops to 0 in response to the stop of the cylinder injection. In contrast, the cylinder evaporated volume (dashed line) does not drop to 0 immediately but gradually decreases after the stop of the cylinder injection. The air-fuel ratio thus may vary in response to the evaporation of the fuel remaining in the cylinder from the time $t_0$ to a time $t_1$, regardless of the stop of the cylinder injection.

Figure 6B:
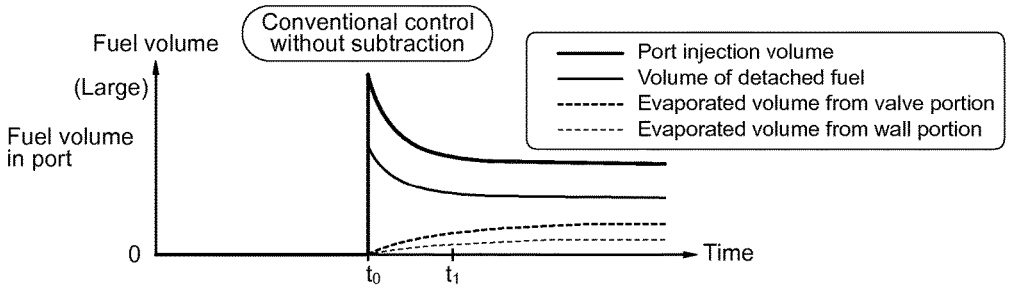

In a conventional control in the MPI mode, the port injected volume $F_{MPI}$ is controlled as illustrated with a thick solid line in FIG. 6B. At the time to, no fuel is adhering on the intake port 13 as illustrated with two dashed lines. The port injected volume $F_{MPI}$ immediately after the time to is thus corrected so as to increase with the port adhesion volume ($R_V+R_W$). The evaporating fuel, however, remains in the cylinder from the time to $t_0$ the time $t_1$, as explained above. Even if the port adhesion volume ($R_V+R_W$) is accurately calculated, the control without consideration of the effects of the remaining fuel leads to a higher air-fuel ratio than intended, as illustrated with a dashed line in FIG. 6D.

Figure 6C:
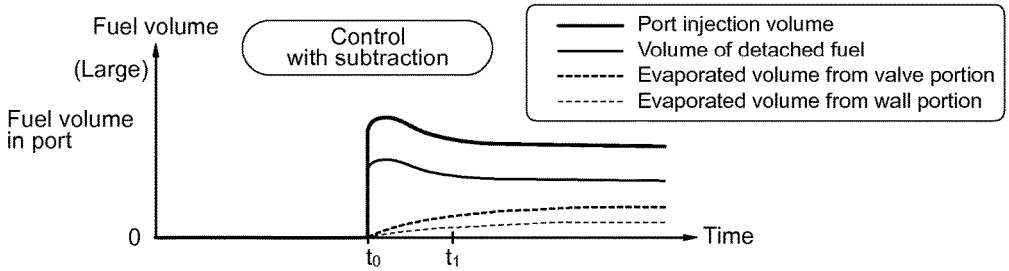
Figure 6D:
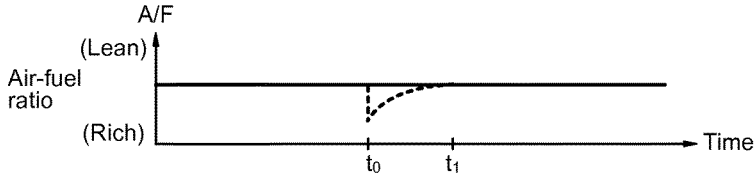

In contrast, the engine controlling apparatus 1 subtracts the cylinder evaporated volume $Z \times R_C$ from the port injected volume $F_{MPI}$ if the cylinder evaporated volume $Z \times R_C$ is equal to or larger than the required cylinder-injected volume $QF_{DI}$. This control slightly reduces the port injected volume $F_{MPI}$ immediately after the switching of fuel injection modes, as illustrated in FIG. 6C. The reduction in the port injected volume $F_{MPI}$ corresponds to the cylinder evaporated volume $Z \times R_C$. This control can compensate for the evaporated volume of the fuel remaining in the cylinder and thus can avoid a high air-fuel ratio. Accordingly, the air-fuel ratio barely varies as intended, as illustrated with a solid line in FIG. 6D.

[5-2. Switching from MPI Mode to DI Mode]

The same control operations also occur in the switching from the MPI mode to the DI mode.

Figure 7A:
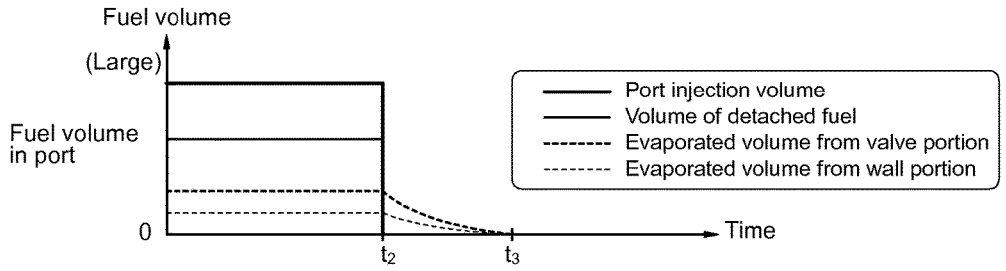
FIGS. 7A to 7D are graphs illustrating control operations in the switching from port injection to cylinder injection.

As illustrated with a thick solid line in FIG. 7A, the port injected volume $F_{MPI}$ is constant in the MPI mode. The volume of the fuel not adhering on the intake port 13 is calculated through subtraction of the port adhesion volume $(R_V+R_W)$ from the port injected volume $F_{MPI}$, and is smaller than the port injected volume $F_{MPI}$, as illustrated with a thin solid line. The port evaporated volume is equal to the sum of the product (thick dashed line; $X \times R_V$) of the volume $R_V$ of the fuel adhering on the intake valve 15 and the valve evaporation rate X, and the product (thin dashed line; $Y \times R_W$) of the volume $R_W$ of the fuel adhering on the inner wall of the intake port 13 and the wall evaporation rate Y. In the MPI mode, the port injected volume $F_{MPI}$ is corrected so as to increase with the port adhesion volume $(R_V+R_W)$ or to decrease with the port evaporated volume $(X \times R_V+Y \times R_W)$.

At a time $t_2$ of the switching of fuel injection modes from the MPI mode to the DI mode, both the port injected volume $F_{MPI}$ and the volume of the fuel not adhering on the intake port 13 (thin solid line) drop to 0. In contrast, the port evaporated volume (two dashed lines) does not drop to 0 immediately but gradually decreases after the stop of the port injection. The air-fuel ratio thus may vary in response to the evaporation of the fuel remaining in the intake port 13 from the time $t_2$ to a time $t_3$, regardless of the stop of the port injection.

Figure 7B:
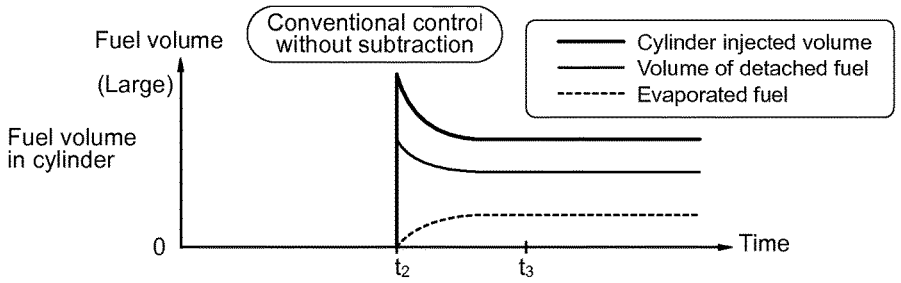

In a conventional control in the DI mode, the cylinder injected volume $F_{DI}$ is controlled as illustrated with a thick solid line in FIG. 7B. At the time $t_2$, no fuel is adhering on the cylinder as illustrated with a dashed line. The cylinder injected volume $F_{DI}$ immediately after the time $t_2$ is thus corrected so as to increase with the cylinder adhesion volume $R_C$. The evaporating fuel, however, remains in the intake port from the time $t_2$ to the time $t_3$, as explained above. Even if the cylinder adhesion volume $R_C$ is accurately calculated, the control without consideration of the effects of the remaining fuel leads to a higher air-fuel ratio than intended, as illustrated with a dashed line in FIG. 7D.

Figure 7C:
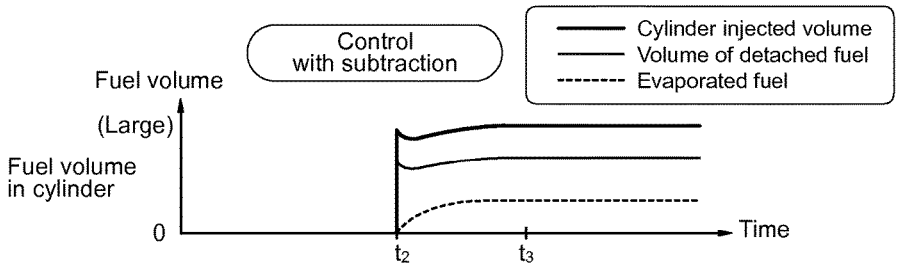
Figure 7D:
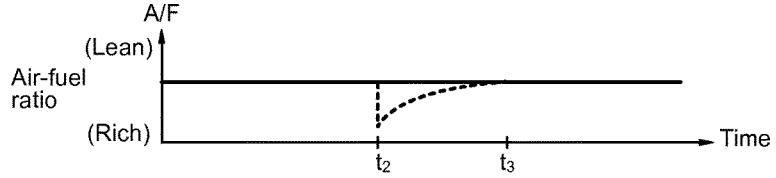

In contrast, the engine controlling apparatus 1 subtracts the port evaporated volume $(X \times R_V+Y \times R_W)$ from the cylinder injected volume $F_{DI}$ if the port evaporated volume $(X \times R_V+Y \times R_W)$ is equal to or larger than the required port-injected volume $QF_{MPI}$. This control slightly reduces the cylinder injected volume $F_{DI}$ immediately after the switching of fuel injection modes, as illustrated in FIG. 7C. The reduction in the cylinder injected volume $F_{DI}$ corresponds to the port evaporated volume $(X \times R_V+Y \times R_W)$. This control can compensate for the evaporated volume of the fuel remaining in the intake port 13 and thus can avoid a high air-fuel ratio. Accordingly, the air-fuel ratio barely varies as intended, as illustrated with a solid line in FIG. 7D.

[6. Advantageous Effects]

(1) The engine controlling apparatus 1 calculates the cylinder adhesion volume $R_C$ and the port adhesion volume $(R_V+Rv)$, and controls the volumes $F_{DI}$ and $F_{MPI}$ of fuel respectively injected from the cylinder injection valve 21 and the port injection valve 22 based on both of the calculated volumes. This control can optimize the volume of fuel to be combusted in the combustion chamber 12 under precise control of the air-fuel ratio. In addition, the cylinder adhesion volume $R_C$ and the port adhesion volume $(R_V+R_W)$ are calculated based on the actual volumes $F_{DI}$ and $F_{MPI}$ of fuel injected in the preceding combustion cycle. The effects of the adhering fuel are thus taken into consideration for the subsequent fuel control, leading to high response of the air-fuel ratio.

(2) The engine controlling apparatus 1 allows for the volumes of the fuel evaporated from the cylinder (combustion chamber 12) and the intake port 13. For example, the evaporation volume calculator 3C in the engine controlling apparatus 1 calculates the cylinder evaporated volume $Z \times R_C$ and the port evaporated volume $(X \times R_V+Y \times R_W)$, and then calculates the cylinder injected volume $F_{DI}$ based on both of the calculated volumes. This control can determine the cylinder injected volume $F_{DI}$ based on the volume of the fuel evaporated from the intake port 13. The control thus can avoid a high air-fuel ratio in the cylinder caused by the evaporated fuel, under precise control of the air-fuel ratio.

Furthermore, the engine controlling apparatus 1 also calculates the port injected volume $F_{MPI}$ based on both the cylinder evaporated volume $Z \times R_C$ and the port evaporated volume $(X \times R_V+Y \times R_W)$. This control can determine the port injected volume $F_{MPI}$ based on the volume of the fuel evaporated from the cylinder. The control thus can avoid a high air-fuel ratio in the cylinder caused by the evaporated fuel, under precise control of the air-fuel ratio.

(3) The engine controlling apparatus 1 controls the port injected volume $F_{MPI}$ based on the difference calculated through subtraction of the cylinder evaporated volume $Z \times R_C$ from the required port-injected volume $QF_{MPI}$ to be injected from the port injection valve 22. The control involving this subtraction can readily determine the port injected volume $F_{MPI}$ that can compensate for the effects of the fuel evaporated from the cylinder. This control thus can improve the control and the response of the air-fuel ratio.

(4) The difference $TR_C$ is limited to 0 or larger in the calculation of the port injected volume $F_{MPI}$. In other words, the cylinder evaporated volume $Z \times R_C$ is subtracted from the required port-injected volume $QF_{MPI}$ under the condition that the cylinder evaporated volume $Z \times R_C$ is equal to or larger than the required cylinder-injected volume $QF_{DI}$. The control based on this condition can prevent the erroneous calculation when there is no need to consider the effects of the cylinder evaporated volume $Z \times R_C$. This control can ensure compensation for the cylinder evaporated volume $Z \times R_C$ through adjustment of the port injected volume $F_{MPI}$, leading to precise control of the air-fuel ratio.

(5) If the cylinder evaporated volume $Z \times R_C$ is smaller than the required cylinder-injected volume $QF_{DI}$, the cylinder evaporated volume $Z \times R_C$ is subtracted from the cylinder injected volume $F_{DI}$. This control can ensure compensation for the cylinder evaporated volume $Z \times R_C$ through adjustment of the cylinder injected volume $F_{DI}$, leading to precise control of the air-fuel ratio. The engine controlling apparatus 1 thus can prevent a high air-fuel ratio in the cylinder caused by the evaporated fuel under precise control of the air-fuel ratio, regardless of the cylinder evaporated volume $Z \times R_C$.

(6) The engine controlling apparatus 1 controls the cylinder injected volume Fox based on the difference calculated through subtraction of the port evaporated volume ($X \times R_V + Y \times R_W$) from the required cylinder-injected volume $QF_{DI}$ to be injected from the cylinder injection valve 21. The control involving this subtraction can readily determine the cylinder injected volume Fox that can compensate for the effects of the fuel evaporated from the intake port 13. This control thus can improve the control and the response of the air-fuel ratio.

(7) The difference $TR_W$ is limited to 0 or larger in the calculation of the cylinder injected volume Fox. In other words, the port evaporated volume ($X \times R_V + Y \times R_W$) is subtracted from the required cylinder-injected volume $QF_{DI}$ under the condition that the port evaporated volume ($X \times R_V + Y \times R_W$) is equal to or larger than the required port-injected volume $QF_{MPI}$. The control based on this condition can prevent the erroneous calculation when there is no need to consider the effects of the port evaporated volume ($X \times R_V + Y \times R_W$). This control can ensure compensation for the port evaporated volume ($X \times R_V + Y \times R_W$) through adjustment of the cylinder injected volume $F_{DI}$, leading to precise control of the air-fuel ratio.

(8) If the port evaporated volume ($X \times R_V + Y \times R_W$) is smaller than the required port-injected volume $QF_{MPI}$, the port evaporated volume ($X \times R_V + Y \times R_W$) is subtracted from the port injected volume $F_{MPI}$. This control can ensure compensation for the port evaporated volume ($X \times R_V + Y \times R_W$) through adjustment of the port injected volume $F_{MPI}$, leading to precise control of the air-fuel ratio. The engine controlling apparatus 1 thus can avoid a high air-fuel ratio in the cylinder caused by the evaporated fuel under precise control of the air-fuel ratio, regardless of the port evaporated volume ($X \times R_V + Y \times R_W$).

(9) The engine controlling apparatus 1 calculates the ratio $R_{DI}$ of the cylinder injection, which corresponds to the injection ratio between the cylinder injection and the port injection. The port injected volume $F_{MPI}$ and the cylinder injected volume $F_{DI}$ are calculated based on the calculated ratio $R_{DI}$. The engine controlling apparatus 1 further calculates the port adhesion volume ($R_{V(n-1)} + R_{W(n-1)}$) and the cylinder adhesion volume $R_{C(n-1)}$ in the preceding combustion cycle, based on the port injected volume $F_{MPI}$ and the cylinder injected volume $F_{DI}$. The adhesion volumes are referenced in the calculation of the port evaporated volume ($X \times R_{V(n-1)} + Y \times R_{W(n-1)}$) and the cylinder evaporated volume $Z \times R_{C(n-1)}$.

The calculation based on the ratio $R_{DI}$ leads to precise control of the cylinder injection and the port injection and precise estimation of the effects of the fuel adhering on and evaporated from the cylinder and the port, under precise control of the air-fuel ratio.

[7. Modifications]

The invention is not construed to be limited to the above-described embodiments and may be modified in various manners without departing from the gist. The individual features of the embodiments may be selectively employed as necessary or properly combined with one another.

Although the engine controlling apparatus 1 according to the embodiments includes a control configuration for selecting a fuel injection mode depending on the load P on the engine 10 and the number Ne of engine revolutions, such an injection mode control may be omitted. The control in accordance with the embodiments can be achieved by any engine controlling apparatus 1 for an engine 10 at least including a cylinder injection valve 21 and a port injection valve 22. The engine controlling apparatus 1 is preferably applied to an engine 10 in which the adhering or evaporated volume of the fuel injected from one injection valve may exceed the volume of the fuel to be injected from the injection valve.

According to the embodiments, the required fuel volume QF is calculated based on the load P on the engine 10, the number Ne of engine revolutions, the accelerator position AP, and/or the air-fuel ratio A/F. The required fuel volume QF may also be determined through any other known calculation. The same holds true for the calculation of the cylinder adhesion volume $R_C$ and the port adhesion volume ($R_V + R_W$). In specific, the cylinder adhesion volume $R_C$ and the port adhesion volume ($R_V + R_W$) may also be determined based on the quantitative evaluation of the adherability of the fuel. The same holds true for the calculation of the cylinder evaporated volume and the port evaporated volume.

According to the embodiments, the ease of evaporation of the fuel is evaluated with three parameters (the valve evaporation rate X, the wall evaporation rate Y, and the cylinder evaporation rate Z). Alternatively, the ease of evaporation of the fuel may be evaluated with four or more parameters. For example, even in the same intake port 13, a portion near the cylinder 11 has a different temperature from that of a portion apart from the cylinder 11. The ease of evaporation in the respective portions having different temperatures in the inner wall of the intake port 13 thus may be evaluated with different parameters.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

REFERENCE SIGNS LIST

1 engine controlling apparatus
2 mode determiner (injection ratio determiner)
3 calculator
3A required volume calculator
3B adhesion volume calculator
3C evaporation volume calculator
3D injection volume calculator
4 controller
4A DI controller
4B MPI controller
10 engine
11 cylinder
12 combustion chamber
13 intake port
15 intake valve
21 cylinder injection valve
22 port injection valve

The invention claimed is:

1. An engine controlling apparatus comprising:

a processor and a memory that stores a program that causes the processor to:

calculate, as an adhesion volume calculator, a cylinder adhesion volume (Rc) of fuel adhering to a cylinder, the fuel being injected from a cylinder injection valve of an engine, and a port adhesion volume (Rv+Rw) of fuel adhering to an intake port of the cylinder, the fuel being injected from a port injection valve of the engine;

calculate, as an evaporation volume calculator, a cylinder evaporated volume (Z×Rc) of fuel evaporated from the fuel adhering to the cylinder and a port evaporated volume (X×Rv+Y×Rw) of fuel evaporated from the fuel adhering to the intake port;

calculate, as an injection volume calculator, a cylinder injected volume ($F_{DI}$) of the fuel injected from the cylinder injection valve into the cylinder and a port injected volume ($F_{MPI}$) of the fuel injected from the port injection valve into the intake port;

calculate, as a required volume calculator, a required cylinder-injected volume ($QF_{DI}$) required to be injected from the cylinder injection valve and a required port-injected volume ($QF_{MPI}$) of fuel required to be injected from the port injection valve; and control, as a controller, each of the cylinder injected volume ($F_{DI}$) and the port injected volume ($F_{MPI}$), based on both the cylinder adhesion volume (Rc) and the port adhesion volume (Rv+Rw), wherein when the processor determines that the cylinder evaporated volume (Z×Rc) from one combustion cycle before a current combustion cycle is larger than the required cylinder-injected volume ($QF_{DI}$) upon switching of injection mode to an MPI mode in which the cylinder injected volume ($F_{DI}$) drops to zero, the program causes the processor to control the port injected volume ($F_{MPI}$) based on a difference (($QF_{MPI}$)−(Z×Rc)) calculated through subtraction of the cylinder evaporated volume (Z×Rc) from the required port-injected volume ($QF_{MPI}$), and when the processor determines that the cylinder evaporated volume (Z×Rc) from the one combustion cycle before the current combustion cycle is zero after switching of injection mode to the MPI mode, the program causes the processor to adjust the port injected volume ($F_{MPI}$) to a difference (($QF_{MPI}$)−(X×Rv+Y×Rw)) calculated through subtraction of the port evaporated volume (X×Rv+Y×Rw) from the required port-injected volume ($QF_{MPI}$).

2. The engine controlling apparatus according to claim 1, wherein if the cylinder evaporated volume (Z×Rc) is larger than the required cylinder-injected volume ($QF_{DI}$), the program causes the processor to adjust the port injected volume ($F_{MPI}$) to a volume (($QF_{MPI}$)−(X×Rv+Y×Rw)−(($QF_{DI}$)−(Z×Re))) calculated through subtraction of a difference (($QF_{DI}$)−(Z×Rc)) and the port evaporated volume (X×Rv+Y×Rw) from the required port-injected volume ($QF_{MPI}$), the difference (($QF_{DI}$)−(Z×Rc)) being calculated through subtraction of the cylinder evaporated volume (Z×Rc) from the required cylinder-injected volume ($QF_{DI}$).

3. The engine controlling apparatus according to claim 2, wherein the program causes the processor to adjust the cylinder injected volume ($F_{DI}$) to the difference (($QF_{DI}$)−(Z×Re)) calculated through subtraction of the cylinder evaporated volume (Z×Re) from the required cylinder-injected volume ($QF_{DI}$).

4. The engine controlling apparatus according to claim 3, wherein the program causes the processor to control the cylinder injected volume ($F_{DI}$) based on a difference (($QF_{DI}$)−(X×Rv+Y×Rw) calculated through subtraction of the port evaporated volume (X×Rv+Y×Rw) from the required cylinder-injected volume ($QF_{DI}$).

5. The engine controlling apparatus according to claim 2, wherein the program causes the processor to control the cylinder injected volume ($F_{DI}$) based on a difference (($QF_{DI}$)−(X×Rv+Y×Rw)) calculated through subtraction of the port evaporated volume (X×Rv+Y×Rw) from the required cylinder-injected volume ($QF_{DI}$).

6. The engine controlling apparatus according to claim 2, wherein the program further causes the processor to:

determine, as an injection ratio determiner, an injection ratio between the required cylinder-infected volume ($QF_{DI}$) and the port injection, required port-injected volume ($QF_{MPI}$), wherein the cylinder injected volume ($F_{DI}$) and the port injected volume ($F_{MPI}$) are determined based on the injection ratio.

7. The engine controlling apparatus according to claim 1, wherein the program causes the processor to adjust the cylinder injected volume ($F_{DI}$) to a difference (($QF_{DI}$)−(Z×Re)) calculated through subtraction of the cylinder evaporated volume (Z×Re) from the required cylinder-injected volume ($QF_{DI}$).

8. The engine controlling apparatus according to claim 7, wherein the program causes the processor to control the cylinder injected volume ($F_{DI}$) based on a difference (($QF_{DI}$)−(X×Rv+Y×Rw)) calculated through subtraction of the port evaporated volume (X×Rv+Y×Rw) from the required cylinder-injected volume ($QF_{DI}$).

9. The engine controlling apparatus according to claim 7, wherein the program further causes the processor to:

determine, as an injection ratio determiner, an injection ratio between the required cylinder-infected volume ($QF_{DI}$) and the required ort-injected volume $QF_{MPI}$), wherein the cylinder injected volume ($F_{DI}$) and the port injected volume ($F_{MPI}$) are determined based on the injection ratio.

10. The engine controlling apparatus according to claim 1, wherein the program causes the processor to control the cylinder injected volume ($F_{DI}$) based on a difference (($QF_{D1}$)−(X×Rv+Y×Rw)) calculated through subtraction of the port evaporated volume (X×Rv+Y×Rw) from the required cylinder-injected volume ($QF_{DI}$).

11. The engine controlling apparatus according to claim 1, wherein if the port evaporated volume (X×Rv+Y×Rw) is equal to or larger than the required port-injected volume ($QF_{MPI}$), the program causes the processor to adjust the cylinder injected volume ($F_{DI}$) to a volume (($QF_{DI}$)−(Z×Rc)−(($QF_{MPI}$)−(X×Rv+Y×Rw))) calculated through subtraction of a difference (($QF_{MPI}$)−(X×Rv+Y×Rw)) and the cylinder evaporated volume (Z×Rc) from the required cylinder-injected volume ($QF_{DI}$), the difference (($QF_{MPI}$)−(X×Rv+Y×Rw)) being calculated through subtraction of the port evaporated volume (X×Rv+Y×Rw) from the required port-injected volume ($QF_{MPI}$).

12. The engine controlling apparatus according to claim 1, wherein if the port evaporated volume (X×Rv+Y×Rw) is zero, the program causes the processor to adjust the cylinder injected volume ($F_{DI}$) to a difference (($QF_{DI}$)−(Z×Rc)) calculated through subtraction of the cylinder evaporated volume (Z×Rc) from the required cylinder-injected volume ($QF_{DI}$).

13. The engine controlling apparatus according to claim 1, wherein the program further causes the processor to:

determine, as an injection ratio determiner, an injection ratio between the cylinder injection required cylinder-infected volume ($QF_{DI}$ and the port injection, required port-infected volume ($QF_{MPI}$) wherein the cylinder injected volume ($F_{DI}$) and the port injected volume ($F_{MPI}$) are determined based on the injection ratio.

* * * * *